US007207909B2

(12) United States Patent
Chen

(10) Patent No.: US 7,207,909 B2
(45) Date of Patent: Apr. 24, 2007

(54) DIMPLED AIR HOCKEY PUCK

(76) Inventor: Samuel Chen, Flat M, 3 floor, Kaiser Estate Phase, 3 Hok Yuan Street, Kowloon, Hong Kong (CN)

( * ) Notice: Subject to any disclaimer, the term of this patent is extended or adjusted under 35 U.S.C. 154(b) by 143 days.

(21) Appl. No.: 11/137,027

(22) Filed: May 25, 2005

(65) Prior Publication Data

US 2006/0267273 A1 Nov. 30, 2006

(51) Int. Cl.
*A63B 71/00* (2006.01)

(52) U.S. Cl. ..... 473/588

(58) Field of Classification Search ..... 473/588, 473/589; 273/126 R, 126 A
See application file for complete search history.

(56) References Cited

U.S. PATENT DOCUMENTS

| | | | | |
|---|---|---|---|---|
| 3,726,526 | A * | 4/1973 | Radovich | 473/588 |
| 3,773,325 | A | 11/1973 | Crossman et al. | |
| 3,784,204 | A * | 1/1974 | Felber | 473/588 |
| 3,954,267 | A | 5/1976 | Freeman et al. | |
| 4,283,054 | A * | 8/1981 | Patella et al. | 273/126 R |
| 4,553,758 | A * | 11/1985 | Zehr | 473/588 |
| 5,104,607 | A | 4/1992 | Driska | |
| 5,269,520 | A * | 12/1993 | Vellines | 473/588 |
| 5,320,007 | A * | 6/1994 | Weirauch | 82/1.11 |
| 5,707,308 | A * | 1/1998 | Liu | 473/588 |
| 5,836,840 | A * | 11/1998 | Bustamante et al. | 473/588 |
| 5,928,096 | A | 7/1999 | Boardman et al. | |
| 6,290,619 | B1 * | 9/2001 | Mayer, II | 473/446 |
| 6,905,430 | B2 * | 6/2005 | Davis | 473/588 |
| 2006/0151950 | A1 * | 7/2006 | Buckley | 273/288 |
| 2006/0205545 | A1 * | 9/2006 | Coleman et al. | 473/588 |
| 2006/0267273 | A1 * | 11/2006 | Chen | 273/126 R |

* cited by examiner

*Primary Examiner*—Raleigh W. Chiu
(74) *Attorney, Agent, or Firm*—Clement Cheng

(57) ABSTRACT

An air hockey puck has a disc shaped body and a peripheral ridge or rim facing both upward and downward. The disc body has head and tail surfaces. The head is a plane surface and defined by an annular inner sidewall of the rim. The tail is defined by an inner sidewall at the bottom of the rim. Dimples are formed on the tail facing air-blasting perforations of an air powered hockey game table. Alternatively, the peripheral ridge may have only one dimple surface extending overall without the side wall and still give extra volume of air blast for an increased lift force to the game puck. By controlling the pattern of the dimple at manufacture to be asymmetrical or symmetrical, a fun factor of unexpected motion of the puck can be obtained.

11 Claims, 1 Drawing Sheet

DIMPLED AIR HOCKEY PUCK

BACKGROUND OF THE INVENTION

A. Field of the Invention

The present invention relates to a table game. More particularly, the invention relates to an improvement of air powered hockey game pucks.

B. Description of the Prior Art

Air powered hockey has been a popular game since the early seventies in family rooms and amusement places. Simulating ice hockey, these table games provide a playfield which has a set pattern of small holes, each blasting a steady stream of air. Riding this blanket of air, the puck hit glides across the table with less friction. The Puck is a thin, round projectile which can be shot by the opposing players using the hand-held "mallets". A fan blows air through the hole in the table is to make the puck slippery.

Play should be started with a "face-off" in the center of the game of the game. The object is to get the puck in the opponents's goal and players should stand at each opposite end of the playfield. Players may not cross beyond the center line of the game with mallets. The goal must be guarded from a position outside the "goal zone". When a goal is made, the puck is put in play by the player not having made the goal which makes up the appealingly simple competition of game.

However, after a period of game play at the same game table, it naturally becomes a more familiar game with lesser challenge. There have been efforts to make the game less predictable to keep it interesting. A development of the air powered hockey of U.S. Pat. No. 4,082,282 suggests to provide a varied pattern of perforations to the table playing field so that players will not readily adapt to a game, in which pucks travel with unpredictable speed and directions. Others suggested varying air cushions by adding complex variable air valves and ducting to the table having an evenly perforated playfield.

Still, such perforating schemes are complex to apply to the existing game structures already in use. Peplacing the playfield for new perforations will cost high let alone upgrading to a variable air valves and ducting.

Inversely, U.S. Pat. No. 3,954,267 suggests to add a secondary member to a puck body in order to give unusual rebound characteristics in search of rapid and diverse game action which requires preparation of different materials and assembly thereof.

SUMMARY OF THE INVENTION

The present invention provides novel one-piece puck structure with desirable aerodynamic features embedded therein.

Generally, the puck for use in an air hockey game is comprised of a round disk body having a generally circular recess in its lower side defined by an annular rim which closes the recess against the table surface to capture air for the lift from underneath. To ensure entrapment of an adequate volume of air the downward recess of the puck is so dimensioned as to bridge enough perforations in the playfield. Air hockey pucks have various diameters in colors, e.g. 3.25 inches for large and 2.5 inches for smaller size. Also, the pucks may have same profile at its opposite sides to give the same lift characteristics when flipped or not flipped.

The air hockey puck of the present invention has the typical disk shaped body but is formed with dimples to produce more lift, an aerodynamic force which affects the hovering of the puck. By keeping the airflow from below better attached, the dimples help promote positive hovering of the puck on the playfield.

Although round dimples are preferred, a variety of other shapes can be employed as well. For example, squares, rectangles, and hexagons can be employed as dimple shape. The dimples may be formed at one or both sides of the puck. Also, they may replace the typical downward recess or just be added to the recessed side that gives the puck a dual character, i.e. distinctive head and tail surfaces for two different lift features. The possibility of having different patterns of dimples is open in the scope of the present invention.

This added aerodynamic force to the puck could be further twisted by irregularly patterning the dimples resulting in an unpredictable fun factor to the puck motion in the air powered hockey game. Embodiments of the invention will now be described by way of example with reference to the accompanying drawings.

BRIEF DESCRIPTION OF THE DRAWINGS

Similar reference numbers denote corresponding features throughout the attached drawings.

DETAILED DESCRIPTION OF THE PREFERRED EMBODIMENT

Figure 1:
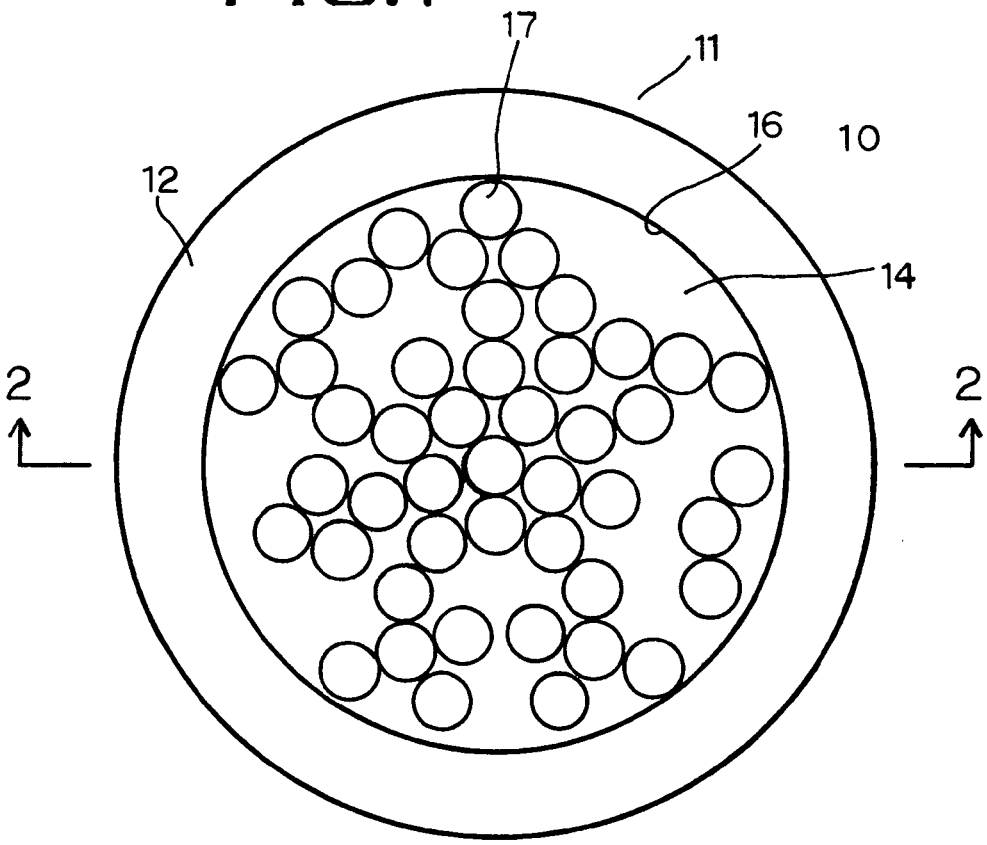
FIG. 1 a bottom view showing the tail surface of the air powered hockey puck.
Figure 2:
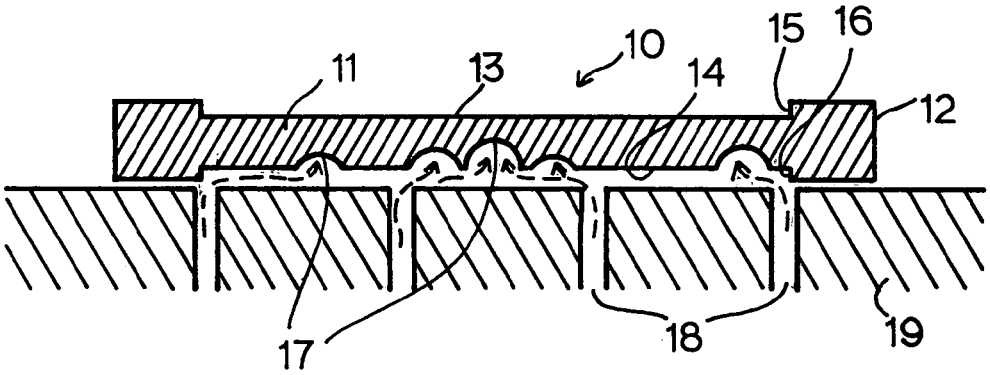
FIG. 2 is a cross-sectional view taken along the line 2—2 of FIG. 1.

With reference to FIGS. 1 and 2, an air powered hockey puck 10 has a disc shaped body 11 and a peripheral ridge or rim 12 facing both upward and downward. The disc body 11 has head 13 and tail 14 surfaces. The head side 13 is a flat plane surface and defined by an annular inner sidewall 15 of the rim 12. The tail side 14 is defined by an inner sidewall 16 at the bottom of the rim 12. Dimples 17 are formed on the tail 14 facing air blasting perforations 18 of an air powered hockey game table 19.

Puck 10 is here shown as hovering over the table 19 after it being hit by a player's mallet not shown and projected across the playfield. Dimples 17 are not limited in their shape and pattern. For example, the dimple 17 is round but it may also be a square, rectangle or hexagon within the scope of the invention. The pattern of the dimples 17 are shown as asymmetrical but it may be symmetrical also. Puck 10 is made of plastics that can be molded into shape as is well known in the art.

Such construction of puck 10 is immediately ready for use at the air powered hockey game wherein an aggressor projects the puck 10 with a mallet toward the goal of the opponent. The puck 10 will show unique aerodynamic characteristics that better simulates the real hockey plays where multiple players pass the puck among them before confronting the goalie. The irregular pattern of dimples 17 generates a non-uniform lift of the puck 10 by capturing different amounts of air blown to different areas of the tail surface 14.

Therefore, besides the main function of the dimples to produce higher lift with lesser blasting energy they can add a fun factor to the game by allowing the puck to travel faster and in more varied ways. When hit by the mallets and bounced by the tablesides, puck 10 can be made slightly deflected left or right in order to have the game more challenging.

If the player wants otherwise, the puck 10 can be turned over so that the head side 13 faces down and the typical lift may be generated.

Figure 3:
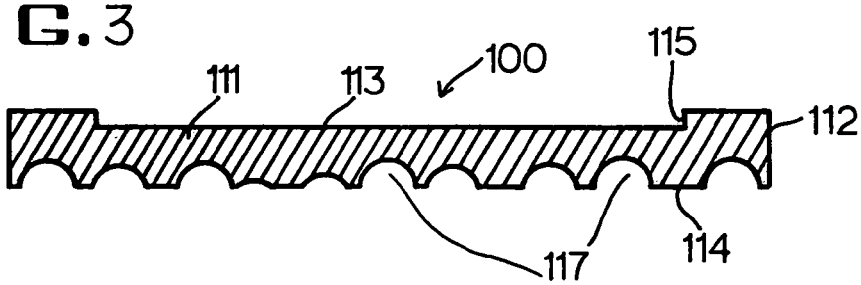
FIG. 3 is a sectional view of the air powered hockey puck in accordance with a second embodiment of the present invention.

FIG. 3 shows a second embodiment of the present invention wherein a puck 100 has a disc shaped body 111 and a peripheral ridge or rim 112 facing upward only. The disc body 111 has head 113 and tail side 114 surfaces. The head 113 is a plane surface and defined by an annular inner side wall 115 of the rim 112. The tail side 114 extends throughout the disc body 111. On the tail side 114 there are formed dimples 117 to face the air blasting perforations 18 as shown in FIG. 2.

The dimples 117 may be similarly shaped as round but they may also be squares, rectangles or hexagons. Dimples 117 all over the flat surface of the tail side 114 will save the puck 100 from needing any other wall design at the rim 112.

It is to be understood that the present invention is not limited to the sole embodiment describe above, but encompasses any and all embodiments within the scope of the following claims.

The invention claimed is:

1. A game puck for use on an air powered hockey table comprising:

a disc shaped body having a head and a tail surface whereby one of which faces a number of air blasting perforations of said hockey table when in use, a peripheral ridge to define the outward limits of said disc body, hitting sides as well as annular side wall inwardly to receive the lifting force of the air blast, said annular side wall being provided at both of said head and tail surfaces, and a plurality of dimples formed on one of said head and tail surfaces, whereby said dimples of said puck may capture extra volume of air blast for an increased lift force to said game puck.

2. The game puck of claim 1, wherein one of said head and tail surfaces has dimples and the other is plane, whereby said puck can be flipped selectively by players in game to give unexpected projections to said puck.

3. The game puck of claim 1, wherein said dimple of one of said head and tail is round.

4. The game puck of claim 1 wherein said dimple of one of said head and tail is selected from the shape of a square, rectangle, and hexagon.

5. The game puck of claim 1, wherein said dimples of one of said head and tail are formed in a predetermined pattern including asymmetrical and symmetrical shape.

6. A game puck for use on an air powered hockey table comprising:

a disc shaped body having a head and tail surfaces whereby one of which faces a number of air blasting perforations of said hockey table, a peripheral ridge to define outwardly of said disc body, hitting sides as well as annular side wall inwardly to receive the lifting force of the air blast, said annular side wall being provided at one of said head or tail surfaces, and a plurality of dimples formed on said head or tail surface defined by said annular side wall, whereby said dimples of said puck may capture extra volume of air blast for an increased lift force to said game puck.

7. The game puck of claim 6, wherein one of said head and tail surfaces has dimples overall, whereby said puck can be flipped selectively by players in game to give unexpected projections to said puck.

8. The game puck of claim 6, wherein said dimple is round.

9. The game puck of claim 6, wherein said dimple is selected from the shape of a square, rectangle, and hexagon.

10. The game puck of claim 6, wherein said dimples are formed in a predetermined pattern including asymmetrical and symmetrical shape.

11. A game puck for use on an air powered hockey table comprising:

a disc shaped body having a head and a tail surface whereby one of which faces a number of air blasting perforations of said hockey table when in use;

a peripheral ridge to define the outward limits of said disc body, hitting sides as well as annular side wall inwardly to receive the lifting force of the air blast, said annular side wall being provided at both of said head and tail surfaces;

a plurality of dimples formed on one of said head and tail surfaces, whereby said dimples of said puck may capture extra volume of air blast for an increased lift force to said game puck;

wherein one of said head and tail surfaces has dimples and the other is plane, whereby said puck can be flipped selectively by players in game to give unexpected projections to said puck, wherein said dimple of one of said head and tail is selected from the shape of a square, rectangle, and hexagon, wherein said dimples of one of said head and tail are formed in a predetermined pattern including asymmetrical and symmetrical shape.

* * * * *